US009028283B2

(12) United States Patent
Sato et al.

(10) Patent No.: US 9,028,283 B2
(45) Date of Patent: May 12, 2015

(54) ELECTRIC WIRE CONNECTION STRUCTURE OF CONNECTOR TERMINAL AND METHOD FOR FABRICATING THE SAME

(75) Inventors: Kei Sato, Shizuoka (JP); Shinji Kodama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 67 days.

(21) Appl. No.: 13/884,550

(22) PCT Filed: Dec. 12, 2011

(86) PCT No.: PCT/JP2011/078705
§ 371 (c)(1), (2), (4) Date: May 9, 2013

(87) PCT Pub. No.: WO2012/081552
PCT Pub. Date: Jun. 21, 2012

(65) Prior Publication Data

US 2013/0252481 A1 Sep. 26, 2013

(30) Foreign Application Priority Data

Dec. 13, 2010 (JP) ..... 2010-277268

(51) Int. Cl.
*H01R 43/24* (2006.01)
*H01R 43/048* (2006.01)
(Continued)

(52) U.S. Cl.
CPC ..... *H01R 4/18* (2013.01); *Y10T 29/49185* (2013.01); *H01R 4/185* (2013.01); *H01R 4/70* (2013.01); *H01R 43/005* (2013.01); *H01R 43/048* (2013.01)

(58) Field of Classification Search
CPC ..... H01R 4/185; H01R 4/183; H01R 4/188; H01R 4/20; H01R 43/24; H01R 13/5845; H01R 43/048; H01R 43/058
USPC ..... 439/877–882, 606, 604; 29/863–867, 29/858
See application file for complete search history.

(56) References Cited

U.S. PATENT DOCUMENTS 4,923,416 A * 5/1990 Zinn ..... 439/877
6,068,505 A * 5/2000 Sai ..... 439/422
(Continued)

FOREIGN PATENT DOCUMENTS

CN 1591979 A 3/2005
JP 2001-167821 A 6/2001
(Continued)

OTHER PUBLICATIONS

International Search Report for PCT Patent App. No. PCT/JP2011/078705 (Jan. 10, 2012).
(Continued)

*Primary Examiner* — Gary Paumen
(74) *Attorney, Agent, or Firm* — Kenealy Vaidya LLP

(57) ABSTRACT

It is an objective to enhance sealing performance of a resin mold without subjecting a connector housing to special work. In an electric wire connection structure of a connector terminal in which an end of an electric wire (W) is connected to a rear portion of a connector terminal (10) and in which the electric wire connection is sealed of a resin mold (20), a step (d) that makes an underside (13*b*) of a rearmost end of the connector terminal (10) higher than an underside of an area ahead of the rearmost end is provided between the underside (13*b*) of the rearmost end and the underside (12*b*) ahead of the rearmost end, thereby assuring space (22) that enables filling of a resin which makes up a resin mold (20).

5 Claims, 6 Drawing Sheets

(51) Int. Cl.

| | |
|---|---|
| ***H01R 4/18*** | (2006.01) |
| ***H01R 4/70*** | (2006.01) |
| ***H01R 43/00*** | (2006.01) |

(56) References Cited

U.S. PATENT DOCUMENTS

| | | | | |
|---|---|---|---|---|
| 6,435,921 | B2 * | 8/2002 | Kojima et al. | 439/752 |
| 7,008,274 | B2 * | 3/2006 | Hayashi et al. | 439/877 |
| 2001/0003687 | A1 | 6/2001 | Kondo | |
| 2002/0027013 | A1 | 3/2002 | Kondo | |
| 2002/0028612 | A1 * | 3/2002 | Ushijima et al. | 439/879 |
| 2002/0053458 | A1 | 5/2002 | Kondo | |
| 2005/0026515 | A1 | 2/2005 | Hashimoto et al. | |
| 2005/0112961 | A1 * | 5/2005 | Hayashi et al. | 439/877 |
| 2006/0068653 | A1 * | 3/2006 | Sakaguchi et al. | 439/877 |
| 2009/0186507 | A1 | 7/2009 | Watanabe et al. | |
| 2011/0177728 | A1 * | 7/2011 | Uchiyama et al. | 439/877 |

FOREIGN PATENT DOCUMENTS

| | | | |
|---|---|---|---|
| JP | 2002-315130 | A | 10/2002 |
| JP | 2003-297447 | A | 10/2003 |
| JP | 2004-071469 | A | 3/2004 |
| JP | 2005-050736 | A | 2/2005 |
| JP | 2007-250530 | A | 9/2007 |
| JP | 2008-123913 | A | 5/2008 |
| JP | 2009-087846 | A | 4/2009 |
| TW | 400985 | U | 8/2000 |
| WO | 98/54790 | A1 | 12/1998 |
| WO | W098/54790 | A1 | 12/1998 |

OTHER PUBLICATIONS

Korean Office Action for the related Korean Patent Application No. 10-2013-7015019 dated Jun. 25, 2014.

Japanese Office Action for the related Japanese Patent Application No. 2010-277268 dated Sep. 3, 2014.

Korean Office Action for the related Korean Patent Application No. 10-2013-7015019 dated Dec. 30, 2014.

Chinese Office Action for the related Chinese Patent Application No. 201180059884.2 dated Dec. 18, 2014.

* cited by examiner

ELECTRIC WIRE CONNECTION STRUCTURE OF CONNECTOR TERMINAL AND METHOD FOR FABRICATING THE SAME

TECHNICAL FIELD

The present invention relates to an electric wire connection structure of a connector terminal and a method for fabricating the electric wire connection structure of the connector terminal.

BACKGROUND ART

As illustrated by an example shown in FIGS. 6 and 7, a common connector terminal 10 has in a front portion thereof an electrical connection section 11 for connection with a terminal of an un-illustrated counterpart connector and in a rear portion thereof a front conductor crimping section 12 and a rear sheath crimping section 13 as electric wire connection sections to be crimped and connected with an end of an electric wire W. The conductor crimping section 12 is made up of a bottom plate 14 and a pair of crimping pieces 12*a* and 12*a* which upwardly extend from both lateral edges of the bottom plate 14, assuming a substantially U-shaped cross sectional profile. The sheath crimping section 13 is made up of the bottom plate 14 and a pair of crimping pieces 13*a* and 13*a* which upwardly extend from both lateral edges of the bottom plate 14, assuming a substantially U-shaped cross sectional profile. The conductor crimping section 12 and the sheath crimping section 13 share the common continual bottom plate.

In order to connect this sort of the connector terminal 10 to the end of the electric wire W, an insulated sheath Wb of the electric wire W is cut off by a length to be crimped by the conductor crimping section 12, thereby laying a conductor Wa in the sheath bare. As indicated by arrow A1 shown in FIG. 6, an underside of the conductor crimping section 12 is put on a mold face 1*a* of a lower mold 1 of a pressure molding die, and an underside of the sheath crimping section 13 is put on a mold face 1*b* of the lower mold 1. In this state, as indicated by arrow A2, the bare conductor Wa is put on the bottom plate of the conductor crimping section 12, and a portion of the electric wire Wa covered with the insulated sheath Wb is put on the bottom plate of the sheath crimping section 13. An upper mold 2 is lowered in this state as indicated by arrow A3, thereby rolling the pair of crimping pieces of the conductor crimping section 12 inside with a mold face 2*a* of the upper mold section 2 and rolling the pair of crimping pieces of the sheath crimping section 13 inside with a mold face 2*b* of the upper mold 2. The bare conductor Wa and the portion of the conductor Wa covered with the insulated sheath Wb are crimped so as to be rolled up. The connector terminal 10 and the electric wire W are thereby connected together.

Subsequently, as shown in FIG. 7, the connection between the electric wire W and the connector terminal 10 is molded, if needed, of a resin so as to cover an entire bare portion of the conductor Wa. The wire connection is sealed with a resin mold 20, thereby protecting the conductor Wa against corrosion and rendering the same waterproof. In particular, when the conductor Wa of the electric wire W is made of aluminum or an aluminum alloy and when the connector terminal 10 is made of copper or a copper alloy, if water adheres to a junction between heterogeneous metals, electric corrosion may occur. For this reason, the junction is sealed with the resin mold 20 with a view to preventing the electric corrosion.

Covering a wire connection of a terminal with a resin, such as that mentioned above, has been known in connection with; for instance, Patent Document 1.

RELATED ART DOCUMENT

Patent Document

Patent Document 1: JP-A-2001-167821

SUMMARY OF THE PRESENT INVENTION

Problem that the Present Invention is to Solve

Incidentally, in a case where the wire connection of the connector terminal 10 is covered with the resin mold 20 as mentioned above and where an underside of the connector terminal 10 is covered with the resin, adhesion between an inner bottom face 31*a* of a terminal accommodation space 31 and an underside of a rear portion of the connector terminal 10 will become poor when the connector terminal 10 is inserted into the terminal accommodation space 31 of a connector housing 30 as shown in FIG. 8 and retained by a lance 32, so that accommodation of the connector terminal 10 in the terminal accommodation space 31 will become deteriorated. Accordingly, the connector terminal 10 is molded of a resin under circumstances such that the underside of the connector terminal 10 is not covered with a resin.

However, as designated by chain double-dashed lines in FIG. 7, when the electric wire W is bent upward as a result of external force acting in direction of arrow Y on the electric wire W pulled out of the connector terminal 10, clearance easily develops between the lower end of the sheath crimping section 13 and the electric wire W because the resin mold 20 that covers the electric wire W, a lower end of the sheath crimping section 13 of the connector terminal 10, and its surroundings has a low thickness. Water may infiltrate into the connector housing by way of the clearance.

Conceivable countermeasures include enhancing a sealing property by increasing the thickness of the resin mold 20 that covers the lower end of the sheath crimping section 13 and its surroundings and, as shown in FIG. 8, providing the inner bottom face 31*a* of the terminal accommodation space 31 of the connector housing 30 with a notch 35 to receive an increased-thickness portion of the resin mold 20. However, the countermeasures cause a necessity to subject the connector housing 30 to additional work, which may add to cost.

The present invention has been conceived in light of the circumstances and aims at providing an electric wire connection structure of a connector terminal that enables enhancement of sealing performance exhibited by a resin mold without subjecting a connector housing to special work, as well as providing a method for fabricating the electric wire connection structure of the connector terminal.

Means for Solving the Problem

To accomplish the object, an electric wire connection structure of a connector terminal of the present invention is characterized by features described in (1) and (2) below.

(1) An electric wire connection structure of a connector terminal in which an end of an electric wire is connected to a rear portion of the connector terminal and in which the end of the connected electric wire is sealed of a resin mold, wherein a step that makes an underside of a rearmost end of the connector terminal higher than an underside of an area ahead of the rearmost end is made at a point between the underside of the rearmost end of the connector terminal and the underside located ahead of the rearmost end, and space that enables filling of a resin which forms the resin mold, is assured beneath the rearmost end.

(2) The electric wire connection structure of the connector terminal descried in connection with (1), wherein the connector terminal has in a front portion thereof an electric connection for connecting with a terminal of a counterpart connector, in a rear portion thereof a conductor crimping section to be crimped and connected to a conductor of the end of the electric wire, and a sheath crimping section that is placed behind the conductor crimping section and that is to be crimped to a portion of the end of the electric wire covered with an insulated sheath; and the step is provided between an underside of the sheath crimping section and an underside of the conductor crimping section.

According to the electric wire connection structure of the connector terminal having the configuration described in connection with (1), the step is provided between the underside of the rearmost end of the connector terminal and the underside of the area ahead of the rearmost end, thereby assuring space that enables filling of the resin which makes up the resin mold beneath the underside of the rearmost end of the connector terminal. Therefore, the underside of the rearmost end of the connector terminal can be covered with the resin mold to a thickness that enables provision of sufficient coverage. Accordingly, the rearmost end of the connector terminal can be made sufficiently waterproof. Further, when the connector terminal is inserted into the terminal accommodation space of the connector housing, sealing performance of the resin mold can be enhanced without subjecting the connector housing to special work.

According to the electric wire connection structure of the connector terminal having the configuration described in connection with (2), the step is provided between the underside of the conductor crimping section and the underside of the sheath crimping section. Hence, an underside of a long segment from the front end of the connector terminal to the conductor crimping section can be kept flat. In addition, when the connector terminal is inserted into the terminal accommodation space of the connector housing, the underside having a wide area can be brought into close contact with an inner bottom face of the terminal accommodation space, so that stable accommodation of the connector terminal can be assured.

In order to accomplish the object, a method of the present invention for fabricating an electric wire connection structure of a connector terminal is characterized by a feature described in connection with (3) below.

(3) A method for fabricating an electric wire connection structure of a connector terminal, wherein an end of an electric wire is placed at a rear portion of a connector terminal, wherein the rear portion of the connector terminal is pressed by use of a lower mold and an upper mold to thereby crimp a conductor crimping section, which is situated on a front side of the rear portion of the connector terminal, to a conductor of the end of the electric wire and crimp a sheath crimping section situated rear to a portion of the end of the electric wire covered with an insulated sheath, and wherein an area to which the end of the electric wire is crimped and connected is sealed with a resin mold, the method comprising:

forming a step that makes an underside of the sheath crimping section higher than an underside of the conductor crimping section between the underside of the sheath crimping section and the underside of the conductor crimping section when the rear portion of the connector terminal is crimped to the electric wire by use of the lower mold and the upper mold, thereby assuring beneath the sheath crimping section space that enables filling of a resin which makes up the resin mold.

According to the method for fabricating an electric wire connection structure of a connector terminal having the configuration described in connection with (3), when the rear portion of the connector terminal is crimped to the electric wire, the step is made between the underside of the sheath crimping section and the underside of the conductor crimping section, thereby assuring, beneath the rearmost end of the sheath crimping section, space that enables filling of the resin which makes up the resin mold for sealing the electric wire connection. Therefore, the underside of the rearmost end of the connector terminal can be covered with the resin mold to a thickness that enables provision of sufficient coverage. Accordingly, the rearmost end of the connector terminal can be made sufficiently waterproof. The sealing performance of the resin mold can be enhanced without subjecting the connector housing to special work. Further, the step is formed simultaneously when the connector terminal is crimped to the electric wire. Hence, the step can be easily realized, so long as slight modifications are made to the pressure molding die.

Advantage of the Present Invention

According to the present invention, since space that enables filling of a resin is assured beneath the underside of the rearmost end of the connector terminal, the resin mold can be applied to a thickness that provides a sufficient coverage to the underside of the rearmost end of the connector terminal. Accordingly, a vulnerable point in waterproofing of the rearmost end of the connector terminal situated between the electric wire W and the connector terminal can be compensated for. Sealing performance of the resin mold can be enhanced without subjecting the connector housing to special work.

The present invention has been briefly described above. Details of the present invention will be more clear by reading through embodiments for implementing the present invention, which will be described below, by reference to the accompanying drawings.

EMBODIMENTS FOR IMPLEMENTING THE PRESENT INVENTION

Embodiments of the present invention are hereunder described by reference to the drawings.

In the present invention, a side of a connector terminal that is brought into connection with its counterpart connector terminal is taken as a front side, and a side of the connector terminal that is brought into connection with an electric wire is taken as a rear side.

Figure 1A:
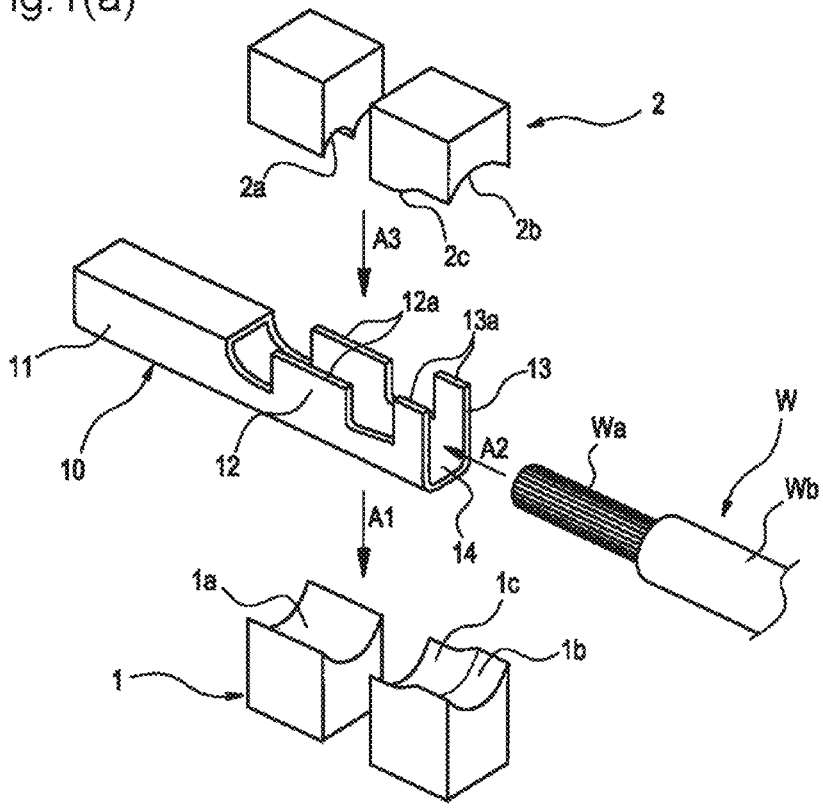
FIG. 1(*a*) and FIG. 1(*b*) are explanatory views of an electric wire connection structure of a connector terminal of a first embodiment of the present invention, wherein FIG. 1(*a*) is a perspective view showing how processing pertinent to a method for fabricating the electric wire connection structure is practiced, and FIG. 1(*b*) is a perspective view showing the electric wire connection structure achieved after connection of an electric wire.
Figure 1B:
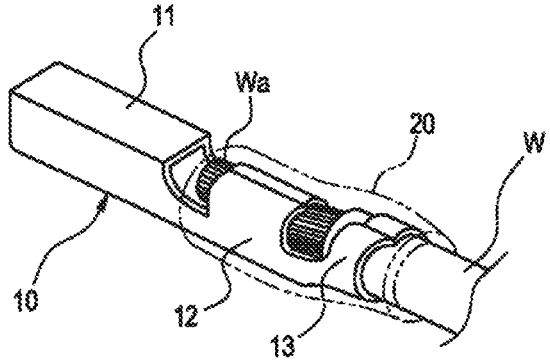
Figure 2A:
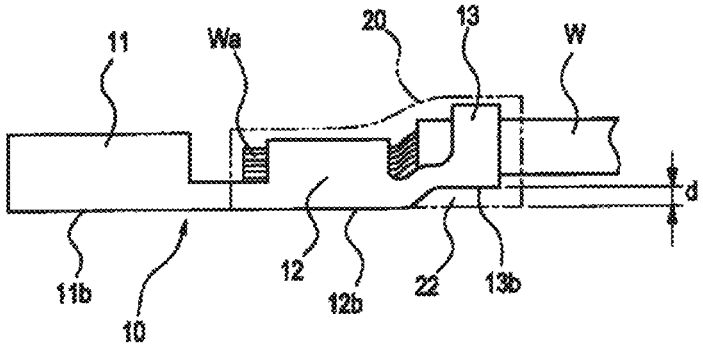
FIG. 2(*a*) is a side view of the electric wire connection structure, and FIG. 2(*b*) is a side cross sectional view of a connector in which the connector terminal having the electric wire connection structure is inserted into a connector housing.
Figure 2B:
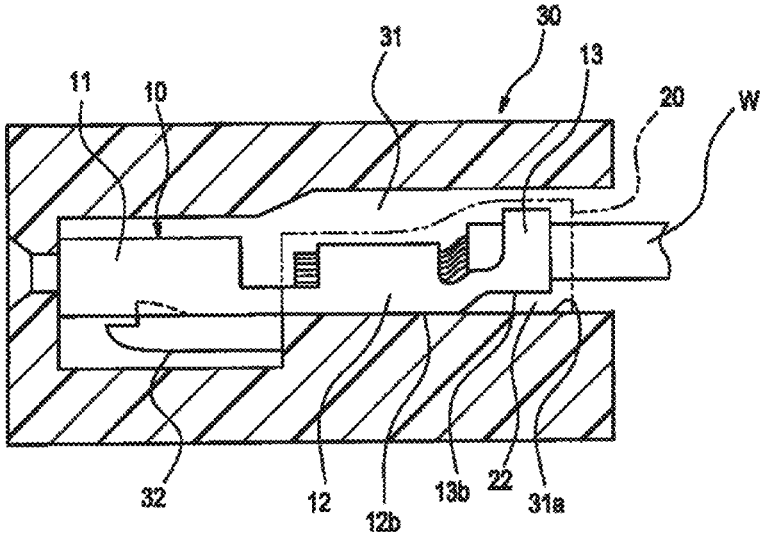

FIG. 1(*a*) and FIG. 1(*b*) are explanatory views of an electric wire connection structure of a connector terminal of a first embodiment of the present invention, wherein FIG. 1(*a*) is a perspective view showing how processing pertinent to a method for fabricating the electric wire connection structure is practiced, and FIG. 1(*b*) is a perspective view showing the electric wire connection structure achieved after connection of the electric wire. FIG. 2(*a*) is a side view of the electric wire connection structure, and FIG. 2(*b*) is a side cross sectional view of a connector in which the connector terminal having the electric wire connection structure is inserted into a connector housing.

A connector terminal 10 is one that is inserted into a terminal accommodation space 31 of a connector housing 30 from the back to thereby be retained by a lance 32. A rectangularly-tubular-box-shaped electric connection 11 used for connection with a terminal of an unillustrated counterpart connector is disposed in a front portion of the connector terminal 10. A front conductor crimping section 12 and a rear sheath crimping section 13 are disposed, as an electrical connection section to be crimped and connected to an end of an electric wire W, in a rear portion of the connector terminal 10. The conductor crimping section 12 and the sheath crimping section 13 share a common continual bottom plate 14. The conductor crimping section 12 is made up of the bottom plate 14 and a pair of crimping pieces 12*a* and 12*a* which are situated backward the electric connection section 11 and that upwardly extend from both lateral edges of the bottom plate 14, assuming a substantially U-shaped cross sectional profile. The sheath crimping section 13 is made up of the bottom plate 14 and a pair of crimping pieces 13*a* and 13*a* which are situated backward the conductor crimping section 12 and which upwardly extend from both lateral edges of the bottom plate 14, assuming a substantially U-shaped cross sectional profile.

When the connector terminal 10 is connected to the end of the electric wire W, there is employed, as shown in FIG. 1(*a*), a pressure molding die made up of a lower mold 1 with stepped mold faces 1*a*, 1*b*, and 1*c* and an upper mold 2 with mold faces 2*a*, 2*b*, and 2*c* having steps corresponding to the steps of the lower mold 1. Specifically, the lower mold 1 is made up of the mold face 1*a* on which an underside 12*b* (see FIG. 2(*a*)) of the conductor crimping section 12 is to be mounted, the mold face 1*b* on which an underside 13*b* (see FIG. 2(*a*)) of the sheath crimping section 13 is to be mounted, and the mold face 1*c* on which an underside of the bottom plate 14 continuous from the conductor crimping section 12 to the sheath crimping section 13 is to be mounted. A height difference (i.e., a step) is given to the mold face 1*b* on which the underside 13*b* of the sheath crimping section 13 is put, in such a way that the mold face 1*b* becomes higher than the mold face 1*a* of the lower mold 1 on which the underside 12*b* of the conductor crimping section 12 is to be put. The mold face 1*c* existing between the mold faces 1*a* and 1*b* is formed as an inclined plane. The mold faces 2*a*, 2*b*, and 2*c* of the upper mold 2 are also formed so as to correspond to their counterpart mold faces 1*a*, 1*b*, and 1*c* of the lower mold 1.

In order to obtain the electric wire connection structure of the first embodiment, an insulated sheath Wb of an electric wire W is cut off by a length to be crimped by the conductor crimping section 12 as shown in FIG. 1(*a*), thereby laying a conductor Wa in the sheath bare. Next, as indicated by arrow A1 shown in FIG. 1(*a*), an underside of the conductor crimping section 12 is put on the mold face 1*a* of the lower mold 1 of the pressure molding die, and an underside of the sheath crimping section 13 is put on the mold face 1*b* of the lower mold 1 of the pressure molding die. As indicated by arrow A2, the bare conductor Wa is, in this state, put on the bottom plate 14 of the conductor crimping section 12, and a portion of the electric wire Wa covered with the insulated sheath Wb is put on the bottom plate 14 of the sheath crimping section 13. The upper mold 2 is lowered in this state as indicated by arrow A3, thereby rolling the pair of crimping pieces 12*a* of the conductor crimping section 12 inside with the mold faces 2*a*, 2*b*, and 2*c* of the upper mold 2 and rolling the pair of crimping pieces 13*a* of the sheath crimping section 13 inside with the mold faces 2*a*, 2*b*, and 2*c* of the upper mold 2. The bare conductor Wa and the portion of the conductor Wa covered with the insulated sheath Wb are crimped so as to be rolled up. The connector terminal 10 and the electric wire W can thereby be connected together.

When the connector terminal 10 is connected to the electric wire W, a step "d" that makes the underside 13*b* of the sheath crimping section 13 higher than the underside 12*b* of the conductor crimping section 12 can be made at a point between the underside 13*b* of the sheath crimping section 13 corresponding to the rearmost end of the connector terminal 10 from which the electric wire W is pulled out and the underside 12*b* of the conductor crimping section 12 corresponding to an area situated ahead of the rearmost end, as shown in FIG. 2(*a*). The step "d" makes it possible to assure space 22 that enables, beneath the underside 13*b* of the sheath crimping section 13, filling of a resin which forms the resin mold 20 for sealing the connection of the electric wire W.

Accordingly, the connection of the electric wire W is molded of a resin so as to cover the entire bare portion of the conductor Wa after crimping, thereby sealing the electric wire connection with the resin mold 20. The conductor Wa can thereby be protected from corrosion and made waterproof. On this occasion, as shown in FIG. 1(*b*) and FIG. 2(*a*), the resin mold can be applied to a thickness that enables sufficient coverage of the underside 13*b* of the sheath crimping section 13 that is the rearmost end of the connector terminal 10. Accordingly, a vulnerable point in waterproofing of the rearmost end of the connector terminal 10 situated between the electric wire W and the connector terminal 10 can be compensated for.

As shown in FIG. 2(*b*), when the connector terminal 10 is inserted into the terminal accommodation space 31 of the connector housing 30 and retained by the lance 32, the connector terminal 10 can be accommodated into the terminal accommodation space 31 without interference with the inner bottom face 31*a* of the terminal accommodation space 31 from the resin mold 20. In this case, the sealing performance exhibited by the resin mold 20 can be enhanced without subjecting the connector housing 30 to special work (work for making a cutout), so a worry about infiltration of water, which would otherwise occur when bending force acts on the electric wire W, is eliminated.

The area of the related-art connector terminal 10 from the underside 12*b* of the conductor crimping section 12 up to the underside 13*b* of the sheath crimping section 13 is made flat. Therefore, when the related-art connector terminal 10 is covered up to its underside with a resin during application of a resin mold, adhesion between an underside of the rear portion of the connector terminal 10 and the inner bottom face 31*a* of the terminal accommodation space 31 might become poor. However, in the electric wire connection structure of the embodiment, the step "d" is provided, in particular, between the underside 12*b* of the conductor crimping section 12 and the underside 13*b* of the sheath crimping section 13. Hence, even when the resin mold 20 is provided, a long segment from an underside 11*b* of the electric connection 11 situated at a front end of the connector terminal 10 up to the underside 12*b* of the conductor crimping section 12 can be kept flat. When the connector terminal 10 is inserted into the terminal accommodation space 31 of the connector housing 30, the underside of the terminal that has a wide area can be brought into close contact with the inner bottom face 31*a* of the terminal accommodation space 31, so that stable accommodation of the connector terminal 10 can be guaranteed.

Figure 3A:
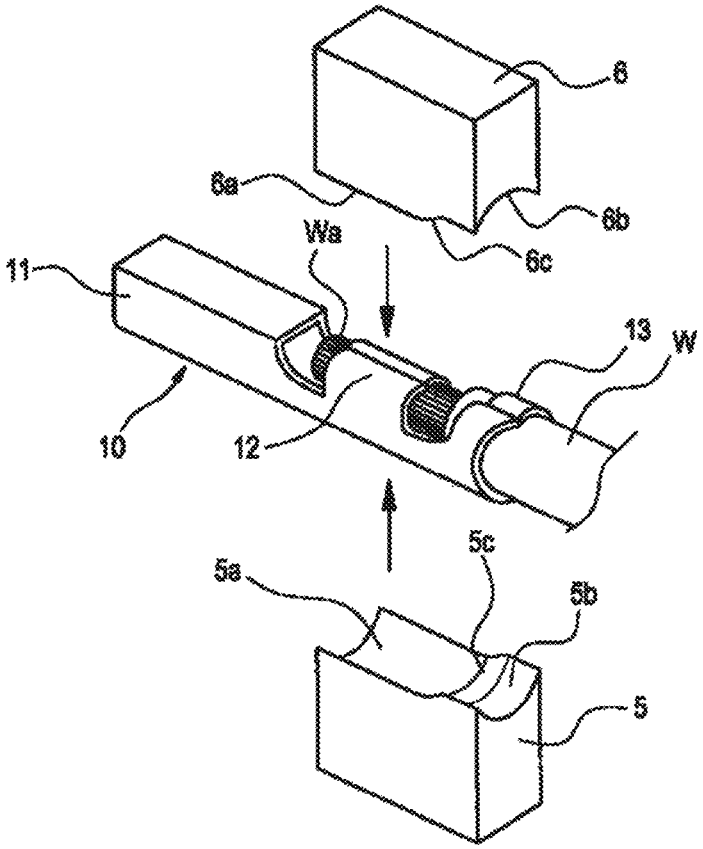
FIG. 3(*a*) and FIG. 3(*b*) are explanatory views of another method for fabricating the electric wire connection structure of the first embodiment of the present invention, wherein FIG. 3(*a*) is a perspective view showing how a step is formed in a rear end of the connector terminal by use of a jig after the connector terminal is crimped to an end of the electric wire, and FIG. 3(*b*) is a perspective view showing the electric wire connection structure achieved after connection of the electric wire.
Figure 3B:
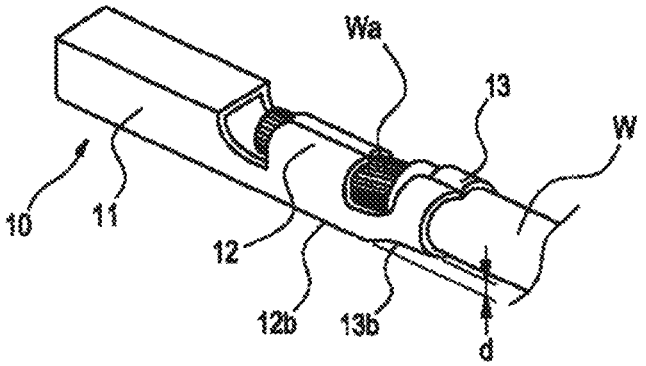

Although explanations have been given to a case where the step "d" is provided concurrently with the instant when the connector terminal 10 is crimped to the electric wire W, it is also possible to crimp the connector terminal 10 to the electric wire W first and make the step "d" in the crimped connector terminal 10 as shown in FIG. 3(*a*) and FIG. 3(*b*).

In this case, a lower jig 5 and an upper jig 6 for use in making a step are used separately from the pressure molding die. Steps used for making the step "d" are made in a mold face of the lower jig 5 and a mold face of the upper jig 6. Specifically, as shown in FIG. 3(*a*), a difference (a step) is provided such that a mold face 5*b* on which the underside 13*b* of the sheath crimping section 13 is put becomes higher than a mold face 5*a* of the lower jig 5 on which the underside 12*b* of the conductor crimping section 12 is put. A mold face 5*c* situated between the mold faces 5*a* and 5*b* is formed as a slope. The mold faces 6*a*, 6*b*, and 6*c* of the upper jig 6 are formed in correspondence to the mold faces 5*a*, 5*b*, and 5*c* of the lower jig 5.

Accordingly, as shown in FIG. 3(*a*), the connector terminal 10 crimped to the electric wire W is put on the lower jig 5 and pressed with the upper jig 6, whereby the step "d" can be made between the underside 12*b* of the conductor crimping section 12 and the underside 13*b* of the sheath crimping section 13 as shown in FIG. 3(*b*).

Figure 4:
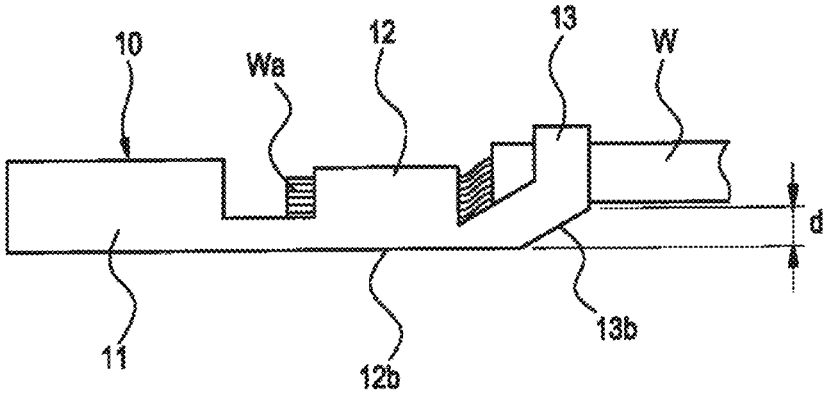
FIG. 4 is a side view of an electric wire connection structure of a second embodiment of the present invention.

So long as the step "d" can be provided between the rearmost end of the connector terminal 10 and the area ahead of the rearmost end, the area where the step "d" is formed can assume any shape. For instance, as can be seen in an electric wire connection structure of a second embodiment shown in FIG. 4, an entirety of the step from the underside 12*b* of the conductor crimping section 12 to the end of the underside 13*b* of the sheath crimping section 13 can also be made obliquely.

Figure 5:
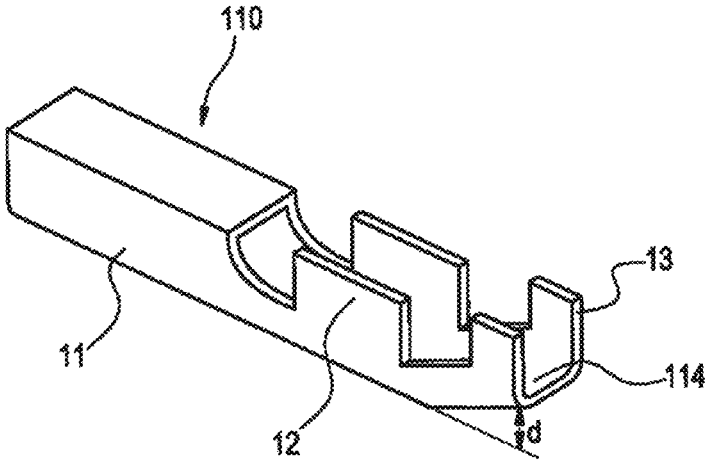
FIG. 5 is a perspective view showing an example of a connector terminal for obtaining the electric wire connection structure of the second embodiment of the present invention.
Figure 6:
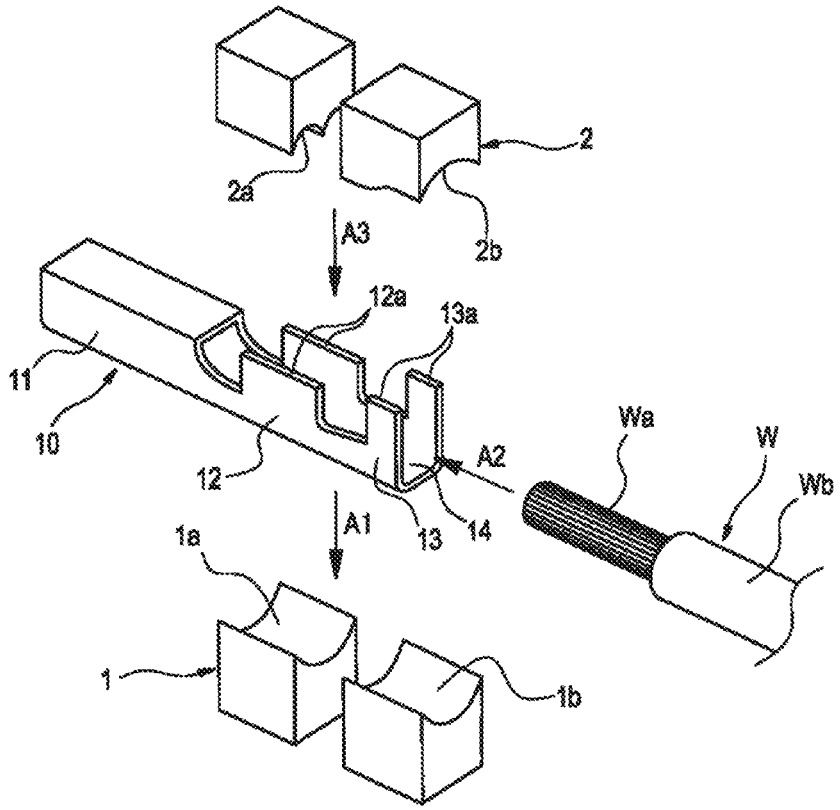
FIG. 6 is an explanatory view of an electric wire connection structure of a related-art connector terminal, or a perspective view showing how processing pertinent to a crimping method for fabricating the electric wire connection structure is practiced.
Figure 7:
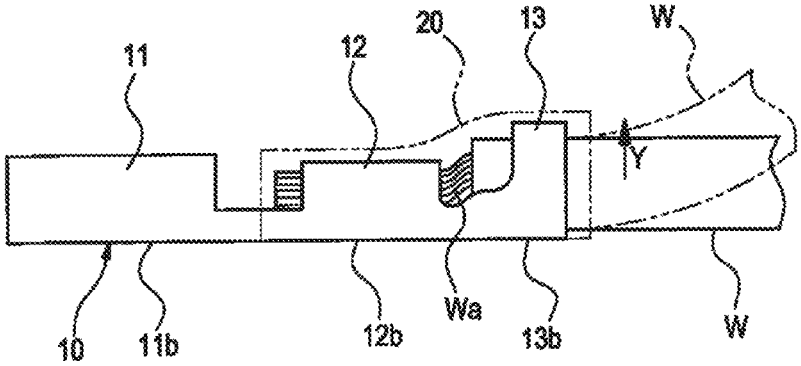
FIG. 7 is a side view of the electric wire connection structure of the related-art connector terminal.
Figure 8:
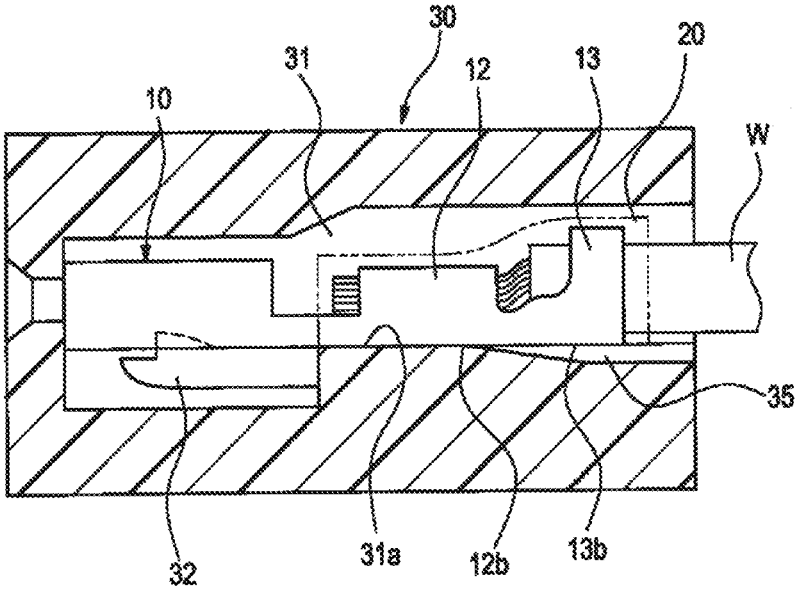
FIG. 8 is a side cross sectional view of a connector formed by inserting the connector terminal equipped with the related-art electric wire connection structure into a connector housing.

The embodiment has provided the explanations about the case where the step "d" is provided concurrently with the instant when the connector terminal 10 is crimped to the electric wire W and the case where the step "d" is provided after crimping. However, the step can also be previously provided between the conductor crimping section 12 and the sheath crimping section 13 at a stage where the connector terminal is fabricated by pressing. FIG. 5 shows an example of such a connector terminal 110. In the connector terminal 110, a bottom plate 114 is formed as a sloped plate from the conductor crimping section 12 to the sheath crimping section 13, whereby the step "d" is provided between the rearmost end of the connector terminal 110 and an area ahead of the rear most end.

The present invention is not restricted to the embodiments and is susceptible to appropriate alterations, improvements, and the like. In addition, the material, the shapes, the dimensions, the number, and the locations of the respective constituent elements described in connection with the embodiments are arbitrary and not restricted, so long as the present invention can be accomplished.

Although the present invention has been described in detail by reference to the specific embodiments, it is manifest to those skilled in the art that the present invention is susceptible to various alterations or modifications without departing the spirit and scope of the present invention. The patent application is based on Japanese Patent Application (JP-2010-277268) filed on Dec. 13, 2010, the subject matter of which is incorporated herein by reference in its entirety.

DESCRIPTIONS OF THE REFERENCE NUMERALS AND SYMBOLS

1 LOWER MOLD
2 UPPER MOLD
10, 110 CONNECTOR TERMINAL
11 ELECTRIC CONNECTION
12 CONDUCTOR CRIMPING SECTION
12*b* UNDERSIDE
13 SHEATH CRIMPING SECTION
13*b* UNDERSIDE
20 RESIN MOLD
22 SPACE
W ELECTRIC WIRE
Wa CONDUCTOR
Wb INSULATED SHEATH
d STEP

The invention claimed is:

1. An electric wire connection structure of a connector terminal in which an end of an electric wire is connected to a rear portion of the connector terminal and in which the end of the connected electric wire is sealed of a resin mold, the connector terminal including a conductor crimping section located at a rear portion of the connector terminal and a sheath crimping section that is located behind the conductor crimping section, wherein a step that makes an underside of a rearmost end of the connector terminal higher than an underside of an area ahead of the rearmost end is provided between the sheath crimping section and the conductor crimping section; and a space that enables filling of a resin which forms the resin mold, is assured beneath the sheath crimping section.

2. The electric wire connection structure of the connector terminal according to claim 1, wherein the connector terminal includes in a front portion thereof an electric connection for connecting with a terminal of a counterpart connector, in a rear portion thereof the conductor crimping section to be crimped and connected to a conductor of the end of the electric wire, and the sheath crimping section that is placed behind the conductor crimping section and that is to be crimped to a portion of the end of the electric wire covered with an insulated sheath; and the step is provided between the underside of the sheath crimping section and the underside of the conductor crimping section.

3. The electric wire connection structure of the connector terminal according to claim 1, the step comprising:

a transition portion connecting the rearmost end of the connector terminal and the area ahead of the rearmost end, the transition portion being sealed in the resin mold.

4. The electric wire connection structure of the connector terminal according to claim 3, wherein the rearmost end of the connector terminal, the transition portion, and the area ahead of the rearmost end are sealed in the resin mold.

5. A method for fabricating an electric wire connection structure of a connector terminal, wherein an end of an electric wire is placed at a rear portion of a connector terminal, wherein the rear portion of the connector terminal is pressed by use of a lower mold and an upper mold to crimp a conductor crimping section, which is situated on a front side of the rear portion of the connector terminal, to a conductor of the end of the electric wire and crimp a sheath crimping section situated rear to a portion of the end of the electric wire covered with an insulated sheath, and wherein an area to which the end of the electric wire is crimped and connected is sealed with a resin mold, the method comprising:

forming a step that makes an underside of the sheath crimping section higher than an underside of the conductor crimping section between the underside of the sheath crimping section and the underside of the conductor crimping section when the rear portion of the connector terminal is crimped to the electric wire by the lower mold and the upper mold, so as to assure beneath the sheath crimping section space that enables filling of a resin which makes up the resin mold.

* * * * *